United States Patent [19]

Keane

[11] Patent Number: 4,858,932

[45] Date of Patent: Aug. 22, 1989

[54] NONUNIFORM PROBABILITY REEL STOP MECHANISM FOR GAMING MACHINES

[75] Inventor: Martin A. Keane, Arlington Heights, Ill.

[73] Assignee: Bally Manufacturing Corporation, Chicago, Ill.

[21] Appl. No.: 184,240

[22] Filed: Apr. 21, 1988

[51] Int. Cl.[4] ..... A63F 5/04

[52] U.S. Cl. ..... 273/143 R; 273/138 A

[58] Field of Search ..... 273/138 A, 143 R, 138 R

[56] References Cited

U.S. PATENT DOCUMENTS

| | | | |
|---|---|---|---|
| 3,580,581 | 5/1971 | Raven | 273/138 A |
| 4,448,419 | 5/1984 | Telnaes | 273/143 R |
| 4,711,451 | 12/1987 | Pajak et al. | 273/143 R |

FOREIGN PATENT DOCUMENTS

| | | | |
|---|---|---|---|
| 0061052 | 9/1982 | European Pat. Off. | 273/138 A |
| 0122138 | 10/1984 | European Pat. Off. | 273/143 R |
| 2131587 | 6/1984 | United Kingdom | 273/143 R |

*Primary Examiner*—Leo P. Picard
*Assistant Examiner*—Jessica Harrison
*Attorney, Agent, or Firm*—Jenner & Block

[57] ABSTRACT

In order to provide a reel type gaming apparatus with the capability to pay out winnings having a higher value than an apparatus where the reels have an equal probability of stopping at each reel stop, a table is created in memory having pairs of lower and upper numerical limits which define groups of subintervals that in turn correspond to reel stops. A random number is generated and the subinterval which includes the number is identified and the reel is stopped at the corresponding reel stop. The interval between the upper and lower limits for each subinterval defines the relative stopping probability for the corresponding reel stop. In another approach probability factors are assigned to each reel stop and a microprocessor subtracts the value of each probability factor from a randomly generated probability value and increments a reel stop index until the probability value is less than the probability factor for the current stop index. Upon a player activated event the current stop index is used to stop the reel in a predetermined position. The relative values of the probability factors correspond to the relative stopping probability of each reel stop.

11 Claims, 5 Drawing Sheets

NONUNIFORM PROBABILITY REEL STOP MECHANISM FOR GAMING MACHINES

TECHNICAL FIELD

The invention relates to the field of gaming devices having rotating reels and more particularly to mechanisms for stopping the reels where the probability of a reel stopping at any one stop is nonuniform.

BACKGROUND OF THE INVENTION

In most reel type gaming machines the symbol bearing reels have an equal probability of stopping at each of the reel stops. This effectively limits the maximum payout for the machine due to the fact that physical size constraints limit the number of reels along with the number of symbols that can be placed on a reel. As an illustration, assume a three reel machine where each reel has 22 symbols and a single reel stop for each symbol with one maximum win symbol on each reel. Then with the reels having an equal probability of stopping at any one stop, the probability of having all three maximum win symbols stop at a win position is $1/22 \times 1/22 \times 1/22$ or 1/10,648. Thus assuming no other winning combinations of symbols are permitted the maximum payout for a dollar machine would be $10,648. As a practical matter, many other winning combinations are desirable in order to maintain player interest in the game so that the actual maximum payout is considerably reduced from this figure.

One approach to solving this problem is to provide reels having two reel stops located very close together for certain symbols on the reels. In this case, the symbols having two reel stops have twice the probability of being stopped in a winning position thus effectively decreasing the odds that a symbol with only one reel stop will appear in the winning position.

Another approach uses the virtual reel concept as disclosed in U.S. Pat. Nos. 4,448,419 and 4,711,451. In a microprocessor controlled virtual reel machine a virtual reel having more stops than the physical reel is placed into memory. The virtual reel is mapped into the physical reel. The microprocessor selects at random one of the stops in the virtual reel and then stops the reel at the physical reel stop corresponding to the randomly selected position in the virtual reel. In this manner it is possible to provide a machine having reels that will proportionately stop at some physical reel stops more than at others.

In U.S. Pat. No. 3,580,581 another approach is disclosed where a series of capacitive resistor circuits are used to control a counter which in turn selects a reel stop. The values of the capacitive resistive circuits may be adjusted to provide for varying time constants for incrementing the counter resulting in a nonuniform probability that any one reel stop will be selected.

Each of the above approaches has disadvantages including limited flexibility in programming win odds in the two stop per symbol and the virtual reel methods and complicated and difficult to maintain circuitry in the counter approach.

SUMMARY OF THE INVENTION

It is therefore an object of the invention to provide a microprocessor controlled reel type gaming apparatus wherein a stop index having values corresponding to each reel stop is randomly selected such that the probability of selection of each value of the stop index is predetermined and non-uniform. Substantial variations in probability of selection of each stop is provided. The probability of selection of each value of the stop index corresponds to a desired probability of a reel stopping at a predetermined location and the microprocessor is effective to stop the reel at the predetermined positions corresponding to the stop index value selected.

It is an additional object of the invention to provide a reel type gaming apparatus including a memory array of randomly selected values partitioned into groups or subintervals of values where each group corresponds to a stop index that in turn corresponds to a stop position on a reel. The range of values in each subinterval correspond to a desired probability of the reel stopping at the stop index value corresponding to that stop position on the reel.

It is a further object of the invention to provide a reel type gaming apparatus including a memory for storing a probability factor associated with each reel stop index where a processor generates a probability value which is then compared to the probability factor associated with the current stop index. If the probability value is greater than the probability factor, the probability factor is subtracted from the probability value resulting in a new probability value and the reel stop is incremented. This comparison process is repeated until the probability value is equal or less than the probability factor. On a periodic basis a new probability value is selected and the comparison process is repeated. The value of the stop index when a player pulls the handle of the machine is used to stop the reel. The probability factors are selected to provide for varying the times for incrementing the stop index resulting in a predetermined but nonuniform probability that any one reel stop will be selected.

DETAILED DESCRIPTION OF THE INVENTION

Figure 1:
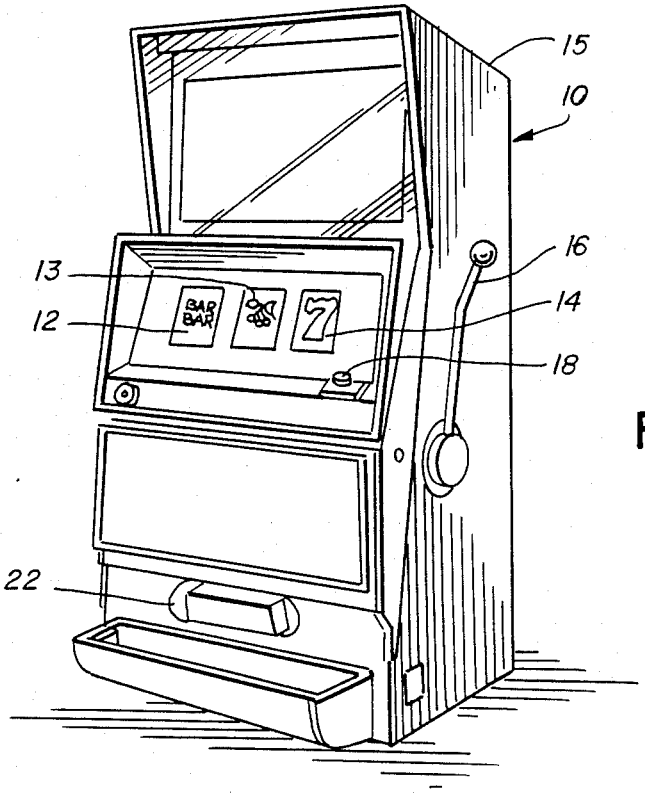
FIG. 1 is a perspective view of a reel-type gaming apparatus.

A gaming apparatus 10 employing the embodiment of the invention is shown in FIG. 1. The gaming apparatus 10 includes three symbol bearing reels 12, 13 and 14 within a housing 15 which are caused to rotate in response to a player actuated handle 16 after a coin is inserted into a coin input slot 18.

Figure 2:
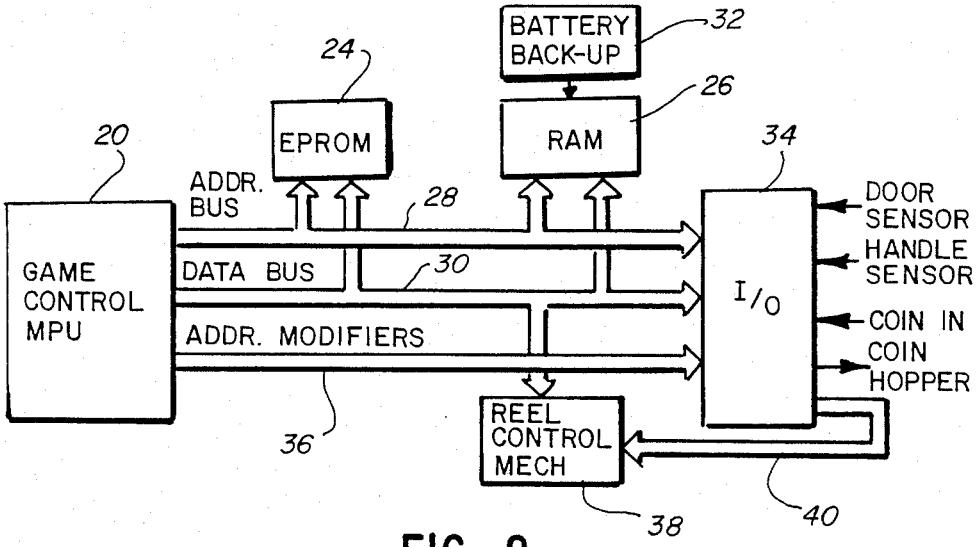
FIG. 2 is a block diagram of the electronic control circuit for gaming apparatus of FIG. 1.

The gaming apparatus 10 includes a game control microprocessor 20, as shown in FIG. 2, which stops each of the reels 12–14 to display three randomly selected symbols along win lines. If the symbols displayed along the win lines form a winning combination, the microprocessor 20 causes a coin hopper (not shown) to payout, through a payout chute 22 a number of coins or tokens.

The game control microprocessor 20, shown in FIG. 2, is preferably a Motorola 68000 processor. The processor 20 controls the operation of the gaming apparatus 10 in accordance with programs and data stored in an EPROM 24 and RAM 26. The EPROM 24 and RAM 26 are coupled to the processor 20 by an address bus 28 and a data bus 30. To ensure that no data stored in the RAM 26 is lost during a power failure, the RAM 26 is coupled to a battery backup circuit 32. The game control microprocessor 20 is also coupled to various input sensors and apparatus as well as the coin hopper through an input/output board 34 which is coupled to the processor 20 through the address and data buses 28 and 30 and an address modifier line 36. In order to address the input/output board 34, the game control processor 20 must output the correct address modifiers for the input/output board on line 36 as well as the address for the input/output board 34 on the address bus 28. The game control microprocessor 20 controls each of the reels 12–14 through a reel control mechanism 38 which is coupled to the data bus 30. The reel control mechanism 38 includes a stepper motor or the like for each of the reels 12–14 to start and stop the rotation of the reels in accordance with the data on bus 40 from the game control microprocessor 20. The reel control mechanism is also coupled to the input/output board 34 which is responsive to the microprocessor 20 for selecting a particular one of the stepper motor controls to receive data from the bus 40.

In a first embodiment of the invention a portion of the EPROM memory 24 contains a stopping probability array for each of the reels 12–14. Each array is divided into partitions or subintervals where each subinterval defines a range of randomly selected values. There is one subinterval X for each reel stop. In this embodiment of the invention the values of the randomly selected values range from 0.000000 to 1.000000 and the range of values in each subinterval are proportional to the desired probability of the reel stopping at the reel stop associated with the subinterval. This concept for a 20 stop reel is illustrated in the Table I reproduced below:

TABLE I

| REEL POSITION X | STOPPING PROBABILITY | SUBINTERVAL LOWER LIMIT | SUBINTERVAL UPPER LIMIT |
|---|---|---|---|
| 1 | 0.010101 | 0.000000 | 0.010101 |
| 2 | 0.020000 | 0.010101 | 0.030101 |
| 3 | 0.030000 | 0.030101 | 0.060101 |
| 4 | 0.040000 | 0.060101 | 0.100101 |
| 5 | 0.050000 | 0.100101 | 0.150101 |
| 6 | 0.060000 | 0.150101 | 0.210101 |
| 7 | 0.070000 | 0.210101 | 0.280101 |
| 8 | 0.080000 | 0.280101 | 0.360101 |
| 9 | 0.089899 | 0.360101 | 0.450000 |
| 10 | 0.050000 | 0.450000 | 0.500000 |
| 11 | 0.050000 | 0.500000 | 0.550000 |
| 12 | 0.050000 | 0.550000 | 0.600000 |
| 13 | 0.050000 | 0.600000 | 0.650000 |
| 14 | 0.050000 | 0.650000 | 0.700000 |
| 15 | 0.050000 | 0.700000 | 0.750000 |
| 16 | 0.050000 | 0.750000 | 0.800000 |
| 17 | 0.050000 | 0.800000 | 0.850000 |
| 18 | 0.050000 | 0.850000 | 0.900000 |
| 19 | 0.050000 | 0.900000 | 0.950000 |
| 20 | 0.050000 | 0.950000 | 1.000000 |

The subinterval limits of Table I are stored in the previously mentioned array along with the subintervals X.

Figure 3:
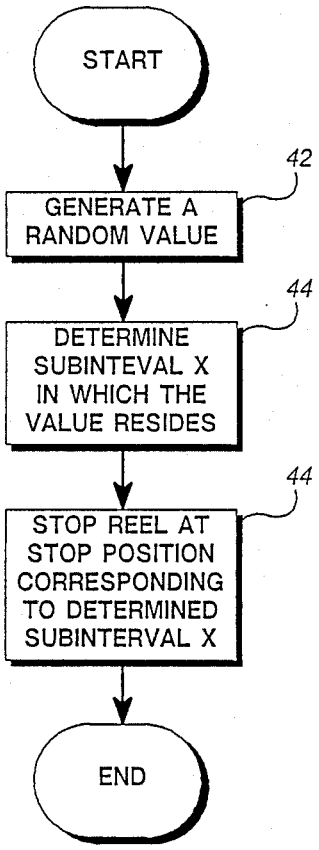
FIG. 3 is a flow chart illustrating reel stop control logic for the chart of FIG. 3.

Operational logic of this reel stop scheme is illustrated by the flow chart of FIG. 3. As shown in the first logic stop 42 a uniformly random value is generated by the processor 20 having a value between zero and 1.00000. Then at 44 the partition or subinterval X in which the randomly generated value resides is determined from the array of Table I. Once the subinterval containing the randomly generated value has been identified, the processor causes the reel control mechanism 38 at step 46 to stop the reel 12, 13 or 14 in the predetermined position corresponding to the subinterval or stop index X.

Figure 4:
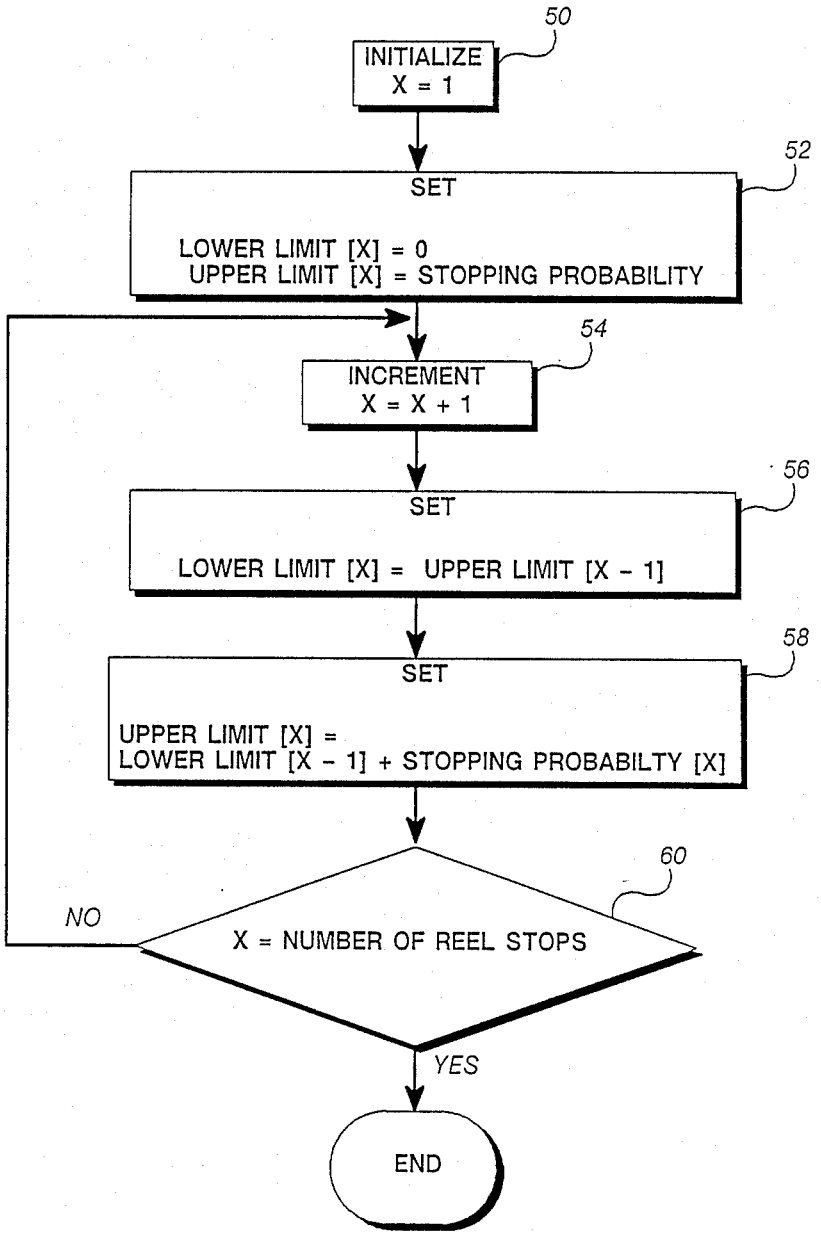
FIG. 4 is a flow chart illustrating control logic for selecting the upper and lower limits for the partitions of the chart of FIG. 5.
Figure 5:
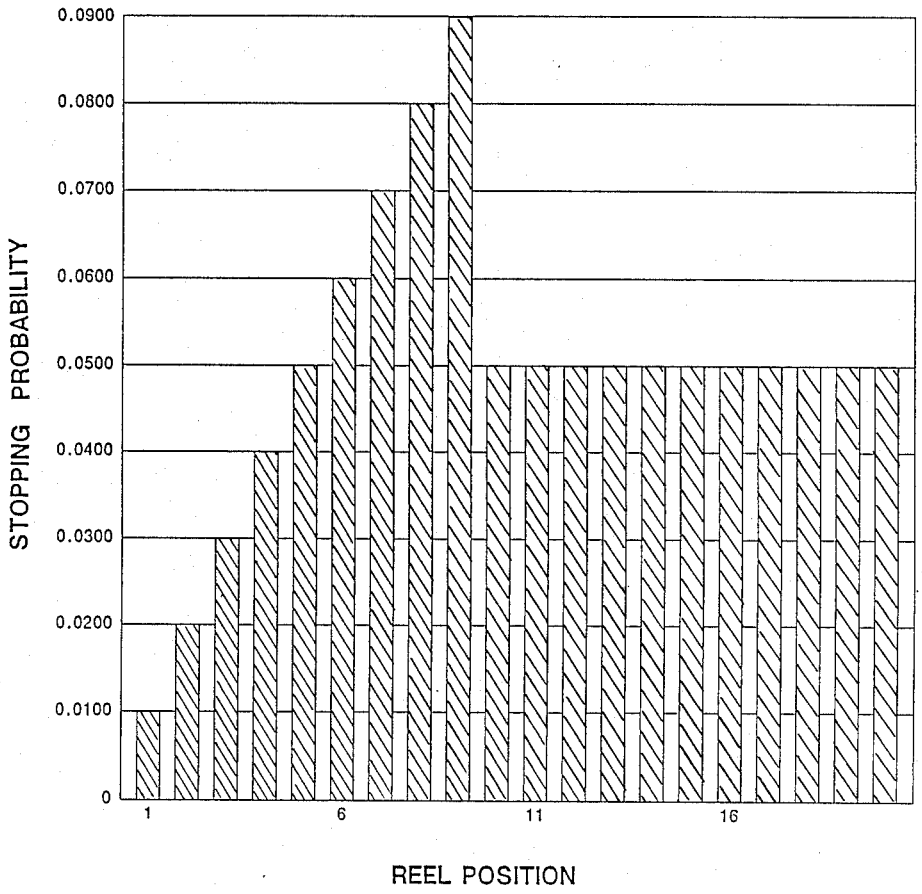
FIG. 5 is a chart illustrating the stopping probability for each reel position for an embodiment of the invention using a memory array of randomly selected values partitioned into groups of stop index values.

As indicated above the range of values in each subinterval of the array corresponds to the probability that the reel 12, 13 or 14 will stop at the reel stop corresponding to the subinterval. In FIG. 4 logic is presented for generating in memory 24 or 26 the subinterval limits that will produce the desired stopping probabilities. In the first step 50 X is initialized to 1 and at 52 the lower limit of the first subinterval is set to zero and the upper limit of the first subinterval is set equal to the desired stopping probability for that subinterval. Then shown at 54 a recursive routine is entered where X is incremented by 1, and at 56 the lower limit of the new value for X is set equal to the upper limit for the preceding value of X. The upper limit for the subinterval of the new value of X is made equal at 58 to the value of the lower limit plus the desired stopping probability for X. As shown at 60 the routine continues until X equals the number of reel stops in the apparatus. In this manner a nonuniform reel stop probability mechanism as illustrated by the chart of FIG. 5 can be created. It will be appreciated that the approach discussed above can provide almost unlimited flexibility in designing a reel type gaming apparatus where the probability of the reel stopping at each reel stop can be adjusted to virtually any desired level.

Figure 6:
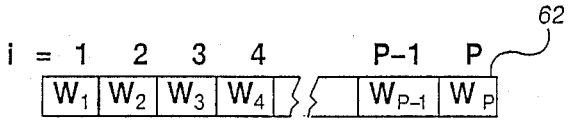
FIG. 6 is an illustration of a probability factor array in the memory of FIG. 1.

In a second embodiment of the invention a portion of non-volatile memory either the EPROM 24 or RAM 26 is configured into an array 62 as shown in FIG. 6 for each reel 12–14 in the apparatus 10. Each element of the array 62 contains a probability factor $W_i$ where i denotes a stop index. There will be a value of i corresponding to each programmed stop for the reels 12–14. For example, if a reel has 24 stops, the value of i will range from 1 to 24 where the subscript p denotes the last or maximum number of reel Thus there will be p elements having probability factor $W_i$ in each array 62.

Figure 7:
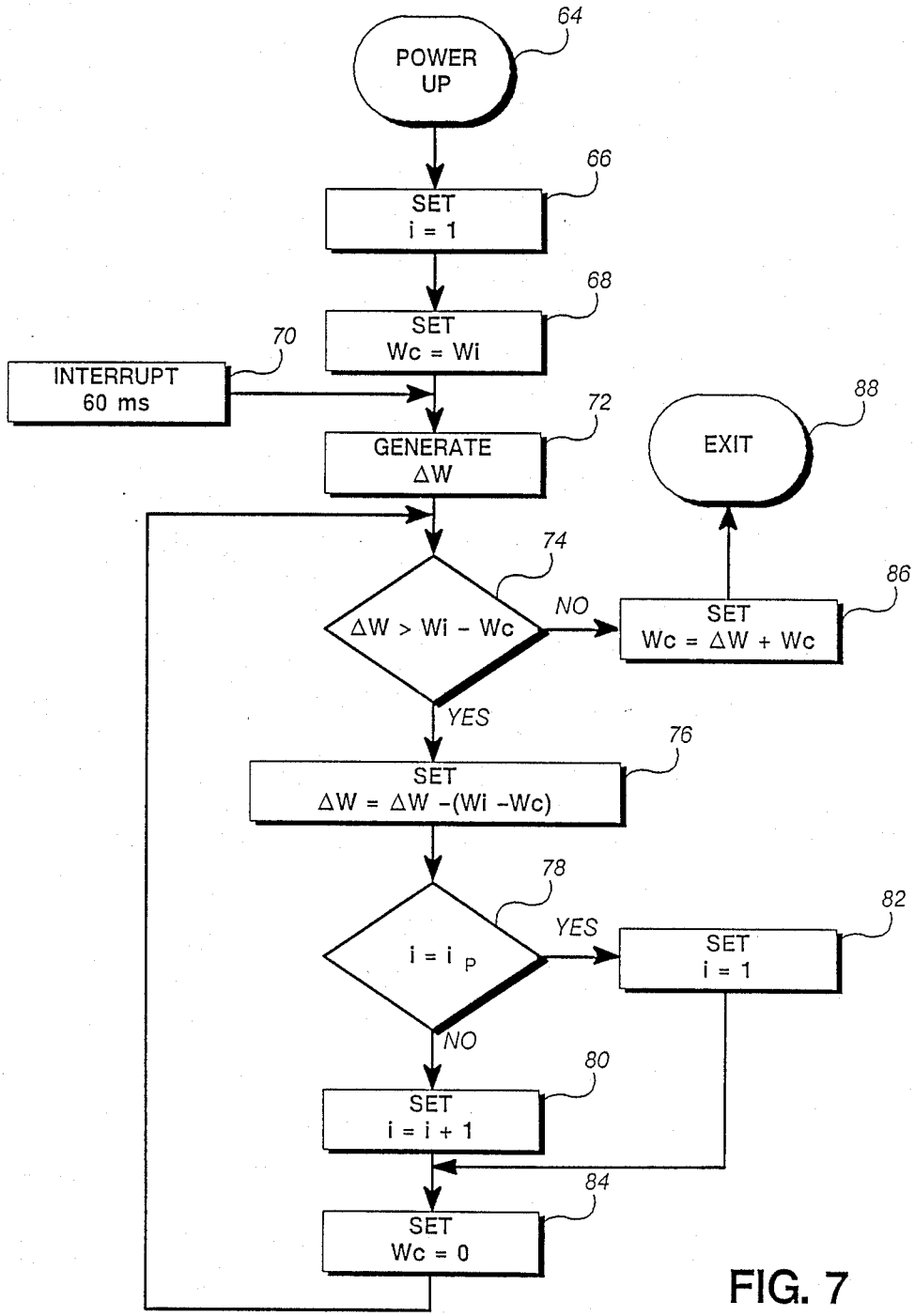
FIG. 7 is a flow chart illustrating the operation of the second embodiment of the invention using the array of FIG. 6.

Operation of the second embodiment of the invention for an individual reel of the gaming machine 10 is illustrated by the flow chart of FIG. 7. For each reel in the apparatus, for example reels 12–14, the microprocessor 20 will independently perform the logic of FIG. 7. When the apparatus 10 is initially powered up as indicated at 64, the processor 20 will set the value of i equal to 1 as shown at 6. The initialization process also includes at 68 the setting of a residual probability value Wc to the value of Wi.

The actual random selection of the reel stop represented by the stop index i begins with a processor 20 initiated interrupt 70. In the preferred embodiment of the invention the interrupt 70 is initiated at regular intervals by the microprocessor 20, preferably every 60 ms for each of the reels 12–14 in the apparatus 10. The first step in the procedure after the interrupt 70 is to randomly select at 72 a probability value represented by ΔW. The preferred parameters for ΔW will be discussed below.

At this point a recursive routine is entered beginning with a comparison at 74 of the value of ΔW to $W_i$ less $W_c$. In the event ΔW is larger than this quantity, the value of $W_i$ minus $W_c$ is subtracted from ΔW at 76. If the value of i is less than the maximum stop index $i_p$ as determined at 78, the value of i is incremented by 1 at 80. On the other hand, if $i=i_p$ then i is reset to 1 at 82. The next step 84 is to set the value of the residual probability $W_c$ to zero and to return to the comparison step at 74.

This routine continues until the value of ΔW is equal to or less than $W_i$-$W_c$ whereupon the value of $W_c$ is set equal to $\Delta W+W_c$ at 86 and the routine initiated by the interrupt 70 is exited as indicated at 88.

as illustrated in FIG. 7 will be

The procedures as illustrated in FIG. 7 will be executed at 60 ms intervals for each reel 12–14 on a continuous basis as long as the apparatus 10 is in operation. The time required to cycle through all the stop indexes i=o to $i_p$ is proportional on the average to the sum of the values of $W_i$ in 62. At a predetermined time after a player initiated an event such as a pull on the handle 16 of FIG. 1, the current value of the stop index i is identified and it is used to stop the reel 12, 13 or 14 at the predetermined position corresponding to that index value. Over an extended period the amount of time that i remains at a particular value will on the average be proportional to the relative corresponding value of the probability factor $W_i$. For example, if $W_5$ equals 2 and $W_6$ equals 1 then on the average i will equal 5 twice as often as it will equal 6. Thus by selecting the appropriate relative values of $W_i$ in FIG. 6 the relative stopping frequencies of the reel stops can be predetermined. In the context of a continuously operating apparatus 10 and in particular with the routine of FIG. 7 running on a continuous basis, the handle pull can be considered a random event. Therefore, the value of i and hence the reel stop position will be selected randomly with the value of i proportional in frequency to the values of $W_i$.

A further randomizing factor is provided by randomly generating the probability value ΔW as shown at 72 in FIG. 7. The probability value ΔW will have a uniform probability distribution. Also in this embodiment of the invention the range of randomly generated values of ΔW can affect the operation of the apparatus 10. If, for example, the permitted maximum value of ΔW is too high, it can introduce a bias factor into the relative probability of the various values of i that are selected by the process of FIG. 7. On the other hand, if the maximum permitted value of ΔW is too low it might be possible for a particularly skilled player to anticipate the stopping positions of the reels 12–14. Therefore in the preferred embodiment of the invention, the maximum value of ΔW should be approximately equal to:

$$\Delta W = \frac{\sum_{i=1}^{p} Wi}{5}$$

Also, the use of the residual probability value $W_c$ as shown at 68, 74, 76, 84 and 86 of FIG. 7 is desirable since it tends to smooth the operation of the process from one 60 ms interrupt interval to another.

As a practical matter it has been found that the procedure of FIG. 7 using the preferred range of values of ΔW and with 60 ms interrupts 70 will on the average cycle twice through all the reel stops indexes i=1 through p every two seconds. Two seconds represents the average duration between handle pulls for a skilled player. Thus the second embodiment of the invention as described above will provide an essentially random selection of reel stops. Further this embodiment of the invention provides a very flexible method for adjusting the relative probability of the reels 12–14 stopping at the various reel stops.

I claim:

1. A gaming apparatus having a symbol bearing reel mounted for rotation about an axis with the reel having a predetermined number of reel stops comprising:

initiation means responsive to a player input for generating an initiate signal;

a digital memory storing a stop index for each of the reel stops and a probability factor for each reel stop that corresponds to each one of said stop indexes;

means responsive to said initiate signal for initiating rotation of the reel; and microprocessor means operatively connected to said digital memory including selection means for randomly selecting one of said stop index values including generating means for generating a probability value, comparison means for comparing said probability value to a selected one of said probability factors associated with one of said stop indexes and if said probability value is greater than said selected probability factor incrementing the selected stop index associated with said selected probability factor, subtracting said selected probability factor from said probability value, and repeating said comparison or alternatively terminating said comparison if said probability value is less than said selected probability factor, means for periodically performing said probability value and comparison operation; and stop means responsive to said selected stop index for stopping the reel at a predetermined location.

2. A gaming apparatus having a symbol bearing reel mounted for rotation about an axis with the reel having a predetermined number of reel stops comprising initiation means responsive to a player input for generating an initiate signal;

a digital memory containing a table of upper and lower subinterval limits wherein each of pairs of said upper and lower subinterval limits defines a subinterval and wherein each subinterval corresponds to a stop index and wherein the range between the lower limit and the upper limit of each subinterval represents a predetermined probability factor;

processor means responsive to said initiation signal for initiating rotation of the reel;

generator means for generating a value; means utilizing said table for determining which of said subintervals contains said value and identifying the corresponding stop index;

stop means responsive to said identified stop index for stopping said reel at a predetermined location corresponding to said identified stop index.

3. The apparatus of claim 2 wherein said value is randomly generated with a substantially uniform distribution.

4. The apparatus of claim 2 wherein the range of said values is at least five significant figures.

5. An apparatus for generating a table of subintervals for use in a memory of a gaming apparatus having X number of reel stops each corresponding to one of the subinterval comprising;

means for initializing the value of X to 1;

first means for setting the lower limit of the first subinterval corresponding to X=1 equal to zero;

second means for setting the upper limit of said first subinterval to a first predetermined stopping probability;

incrementing means for incrementing the value of X by 1;

third means for setting the lower limit for the subinterval corresponding to said incremented X to the value of said upper limit of the subinterval corresponding to X-1;

Fourth means for setting the upper limit of the subinterval corresponding to X to the lower limit of the subinterval corresponding to X plus a predetermined stopping probability for X;

means for comparing the value of X to the maximum value of X for the apparatus and for causing said incrementing means and said third and fourth means to repeat their operations if X is less than said maximum value of X.

6. A gaming apparatus having a symbol bearing reel mounted for rotation about an axis with the reel having a predetermined number of reel stops comprising:

initiation means responsive to a player input for generating an initiate signal;

a memory for storing a probability factor for each reel stop wherein each reel stop has a stop index associated therewith;

processor means responsive to said initiation means and said memory means for initiating rotation of the reel in response to said initiate signal and for stopping the reel wherein said processor means includes:

generating means for generating a probability value;

means for selecting a current one of said stop indexes;

comparison means for implementing a comparison logic step including comparing said probability value to the current reel stop probability factor associated with said current stop index and if said probability value is greater than said selected reel stop probability factor subtracting said current reel stop probability factor from said probability value incrementing said current stop index, and causing said comparison means to repeat said comparison logic step or alternatively causing said comparison means to terminate said comparison logic step if said probability value is less than said current reel stop probability factor;

interrupt means for causing said generating means to generate said probability value and said comparison logic step to be periodically actuated; and stop means responsive to a stop signal for stopping the reel such that the reel stop corresponding to said current stop index stops as a predetermined position.

7. The gaming apparatus of claim 6 wherein said generating means generates said probability values having a random distribution.

8. The gaming apparatus of claim 7 wherein said random probability values have a uniform probability distribution.

9. The gaming apparatus of claim 7 wherein said probability value has a maximum value ΔW according to the relation:

$$\Delta W = \frac{\sum_{i=1}^{p} Wi}{5}$$

where $W_i$ represents the probability factor for the stop index i and p represents the maximum number of stop indexes.

10. The apparatus of claim 9 wherein said processor means additionally includes residual means for generating a residual probability value and wherein said comparison means additionally subtracts said residual probability factor from said selected reel stop probability factor before subtracting said selected reel stop probability factor from said probability value.

11. The apparatus of claim 10 wherein said comparison means additionally sets said residual probability factor to zero after said incrementing of said current stop index.

* * * * *